United States Patent [19]

Skinner

[11] Patent Number: 4,537,359

[45] Date of Patent: Aug. 27, 1985

[54] FUEL INJECTION NOZZLES

[75] Inventor: Robert T. J. Skinner, High Wycombe, England

[73] Assignee: Lucas Industries, p.l.c., Birmingham, England

[21] Appl. No.: 535,696

[22] Filed: Sep. 26, 1983

[30] Foreign Application Priority Data

Oct. 20, 1982 [GB] United Kingdom ..... 8229951

[51] Int. Cl.[3] ..... F02M 61/18; F02M 61/20

[52] U.S. Cl. ..... 239/533.6; 239/533.9

[58] Field of Search ..... 239/533.2, 533.12

[56] References Cited

U.S. PATENT DOCUMENTS

| | | | |
|---|---|---|---|
| 1,735,718 | 11/1929 | Attendu | 239/533.5 |
| 2,927,737 | 3/1960 | Zeuch | 239/533.3 |
| 4,168,804 | 9/1979 | Hofmann | 239/533.11 |

FOREIGN PATENT DOCUMENTS

| | | | |
|---|---|---|---|
| 1026572 | 3/1958 | Fed. Rep. of Germany | 239/533.5 |
| 994588 | 11/1951 | France | 239/533.5 |
| 3224 | 2/1979 | Japan | 239/533.5 |
| 329505 | 4/1958 | Switzerland | 239/533.5 |
| 2072262 | 9/1981 | United Kingdom | 239/533.9 |

*Primary Examiner*—Andres Kashnikow
*Assistant Examiner*—Michael J. Forman

[57] ABSTRACT

A fuel injection nozzle of the inwardly opening type includes first and second coiled compression springs operable to load the valve member to the closed position. The first spring is initially opposed by the second spring and finally assisted by the second spring during the movement of the valve member there being an intermediate range of valve member movement during which the first spring alone resists the movement of the valve member.

4 Claims, 2 Drawing Figures

FUEL INJECTION NOZZLES

This invention relates to fuel injection nozzles for supplying fuel to internal combustion engines, the nozzles being of the so-called inwardly opening type including a valve member slidable within a bore, resilient means biasing the valve member into contact with a seating defined at one end of the bore, a fuel inlet passage through which fuel under pressure can act upon the valve member to lift the valve member away from the seating against the action of the resilient means, thereby to allow fuel flow through an outlet.

The object of the present invention is to provide such a nozzle in a simple and convenient form.

According to the invention in a fuel injection nozzle of the kind specified said resilient means comprises a first coiled compression spring acting on said valve member through an abutment carried by the valve member, a second coiled compression spring, an abutment plate engaged by one end of said second coiled compression spring, said abutment plate being positioned so as to be engaged by a part movable with said valve member after a predetermined movement of the valve member against the action of the first coiled compression spring.

In the accompanying drawings

Figure 1:
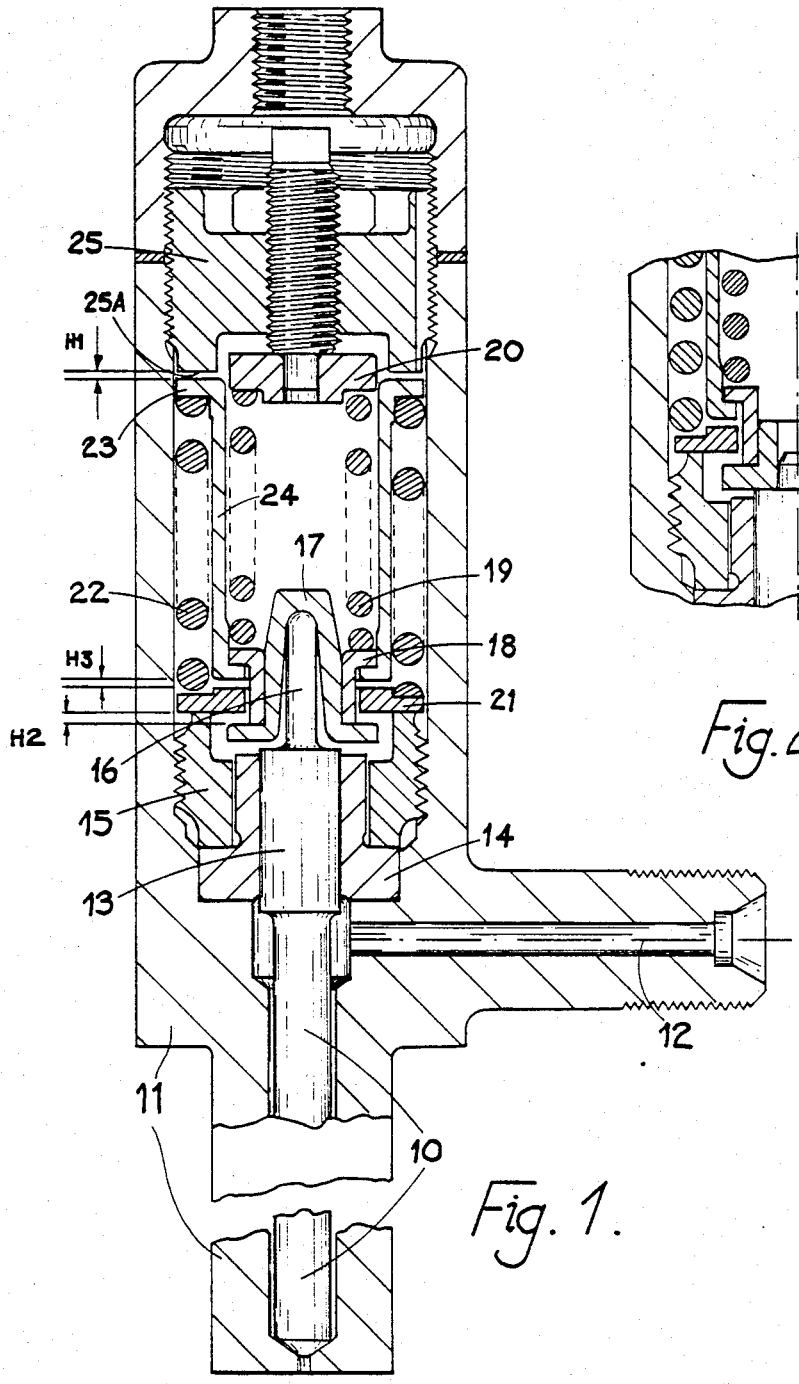
Figure 2:
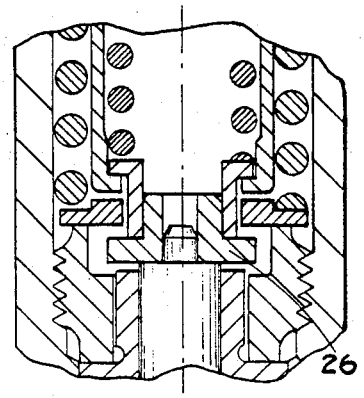

FIG. 1 is a sectional side elevation of a fuel injection nozzle in accordance with the invention, and FIG. 2 is a view similar to FIG. 1 showing a modified form of construction.

Referring to the drawings there is shown a portion of an inwardly opening fuel injection nozzle, the nozzle being of the so-called "pencil" type. In this form of nozzle the valve member 10, is of elongated form with a correspondingly elongated nozzle body 11. In addition, the body has a lateral fuel inlet 12 which communicates with a clearance defined between the valve member and the wall of the bore in which it is located. The valve member has a guide portion 13 slidable within a flanged bush 14 secured in the nozzle body by means of a threaded bush 15. This construction is of course conventional. The valve member 10 is provided with an extension 16 upon which is located a top hat section member 17 which in turn supports a flanged spring abutment 18, the latter being a sliding fit on the member 17 and engaging one end of a coiled compression spring 19, the other end of which is located against an adjustable abutment 20.

An annular spring abutment plate 21 is provided and this in the closed position of the valve member, engages the bush 15. It serves as an abutment for a second coiled compression spring 22, the other end of which engages a flange 23 formed at one end of a tubular member 24, the other end of which has an inwardly directed flange which is located between the abutment plate 21 and the flange of the abutment 18.

In the rest position of the valve member a clearance $H_1$ exists between the flange 23 and a surface 25A on and end closure 25 for the chamber in the body in which the springs are located. A clearance $H_2$ exists between the flange of the member 17 and the abutment plate 21 and a clearance $H_3$ exists between the abutment 21 and the inwardly directed flange on the member 24.

In operation, the initial movement of the valve member when fuel under pressure is supplied to the inlet, is against the action of the spring 19 with the movement being assisted by the action of the spring 22. The movement of the valve member in this manner takes place until the clearance $H_1$ has been taken up. Further movement of the valve member then takes place against the action of the spring 19 with no assistance from the spring 22, until the clearance $H_2$ has been taken up. Thereafter, the movement of the valve member is against the combined action of the springs 19 and 22 until the clearance indicated as $H_3$, has been taken up, it being understood that the total movement of the valve member is the sum of the clearances $H_1$, $H_2$ and $H_3$.

FIG. 2 shows a slightly different construction and it will be observed that the top hat section member 17 has been replaced by a flanged bush 26.

The operation of the nozzle can be modified by, in effect, removing the inwardly directed flange on the member 24. If this is done, the clearance $H_1$ does not exist and the initial movement of the valve member is against the action of the spring 19, the final movement of the valve member being against the action of the two springs acting together.

I claim:

1. A fuel injection nozzle for supplying fuel to an internal combustion engine, the nozzle being of the so-called inwardly opening type including a valve member slidable within a bore, resilient means biasing the valve member into contact with a seating defined at one end of the bore, a fuel inlet passage through which fuel under pressure can act upon the valve member to lift the valve member away from the seating against the action of the resilient means, thereby to allow fuel flow through an outlet, said resilient means comprising a first coiled compression spring acting on said valve member through an abutment carried by the valve member, a second coiled compression spring, an abutment plate engaged by one end of said second coiled compression spring, a part positioned on the valve member so as to be movable therewith, said abutment and said part defining a lower surface on the abutment and an upper surface on said part between which surfaces is located said abutment plate, whereby said abutment plate is positioned so as to be engaged by said part after a predetermined movement of the valve member against the action of the first coiled compression spring, a tubular member having an outwardly extending flange which forms an abutment for the other end of the second coiled compression spring and an inwardly directed flange which in the closed position of the valve member engages the lower surface defined by said abutment carried by the valve member, and means operable during the opening movement of the valve member to halt the movement of said tubular member before said abutment plate is engaged by said part, whereby the initial movement of the valve member is against the action of the first coiled compression spring and the final movement of the valve member is against the action of both compression springs.

2. A nozzle according to claim 1 in which the means for limiting the movement of the tubular member comprises a surface defined on a closure member for a chamber in the nozzle body.

3. A nozzle according to claim 2 in which said closure member carries an adjustable abutment for the end of the first coiled compression spring remote from the valve member.

4. A nozzle according to any one of claims 1, 2 or 3 in which said tubular member is positioned within the second coiled compression spring and surrounding the first coiled compression spring.

* * * * *